US006073912A

United States Patent [19]

Mori et al.

[11] Patent Number: 6,073,912

[45] Date of Patent: Jun. 13, 2000

[54] AL OR AL ALLOY POPPET VALVE AND A METHOD OF MANUFACTURING THE SAME

[75] Inventors: Akiyoshi Mori, Yokohama; Hiroaki Asanuma, Fujisawa, both of Japan

[73] Assignee: Fuji Oozx Inc., Japan

[21] Appl. No.: 09/131,264

[22] Filed: Aug. 7, 1998

[30] Foreign Application Priority Data

Aug. 7, 1997 [JP] Japan ..... 9-213110

[51] Int. Cl.[7] ..... F01L 3/00

[52] U.S. Cl. ..... 251/368; 123/188.3; 29/890.12

[58] Field of Search ..... 251/368; 123/188.3; 29/890.12, 890.129, 890.132

[56] References Cited

U.S. PATENT DOCUMENTS 4,073,474 2/1978 Hashimoto et al. ..... 251/368
4,852,531 8/1989 Abkowitz et al. ..... 251/368

*Primary Examiner*—Steven O. Douglas
*Attorney, Agent, or Firm*—Zarley, McKee, Thomte, Voorhees & Sease

[57] ABSTRACT

An Al alloy poppet valve is used in an internal combustion engine. The poppet valve comprises a valve stem and a valve head at the end of the valve stem. The valve head has a tapered valve face, which is engaged on a valve seat when an inlet port is closed by the poppet valve. The valve face has a thermal hardened layer on the surface and an inner alloy layer, thereby increasing mechanical strength to provide high durability and reliability.

6 Claims, 3 Drawing Sheets

AL OR AL ALLOY POPPET VALVE AND A METHOD OF MANUFACTURING THE SAME

BACKGROUND OF THE INVENTION

The present invention relates to an Al or Al alloy poppet valve in an internal combustion engine, and a method of manufacturing the same.

Inlet and exhaust poppet valves in an internal combustion engine for a vehicle is generally made of heat-resistant steel such as martensite and austenite. Recently an inlet valve which has relatively low thermal load is made of Al alloy.

The heat resistant steel valve has high mechanical strength, and provides high durability and reliability, but has high inertia mass and low heat conductivity.

The Al alloy inlet valve which is light decreases inertia mass of a valve-operating mechanism, and increase engine performance, thereby providing high heat conductivity and high heat release performance to the cylinder head to increase cooling performance of the engine.

However, Al alloy has low mechanical strength and especially low wear resistance on the valve face to provide low durability and reliability.

SUMMARY OF THE INVENTION

In view of the foregoing disadvantages, it is an object of the present invention to provide an Al alloy poppet valve in an internal combustion engine which provides increase in strength, especially in mechanical strength of a valve face, and a method of manufacturing it.

According to one aspect of the present invention, there is provided an Al or Al alloy poppet valve in an internal combustion engine, said valve comprising a valve stem and a valve head at an end of the valve stem, said valve head having a valve face which is engageable on a valve seat, said valve face having a thermal hardened layer at a surface, and an inner alloy layer which contains reinforcement material.

Thus, the poppet valve increases durability to impact and mechanical strength.

According to another aspect of the present invention, there is provided a method of manufacturing an Al or Al alloy poppet valve in an internal combustion engine, said method comprising the steps of:

- supplying a reinforcement material onto a valve face of a valve head of the poppet valve;
- melting said reinforcement material by high energy heating means to make said valve face to an alloy;
- applying T6 treatment to said alloy-changed valve face; and
- melting an outermost layer of the valve face subjected to T6 treatment again by said high energy heating means to form a thermal hardened layer.

Hardeness and strength of the valve face of the Al or Al alloy poppet valve are increased, thereby decreasing inertia mass of a valve operating mechanism to increase engine performance.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENTS

Figure 1:
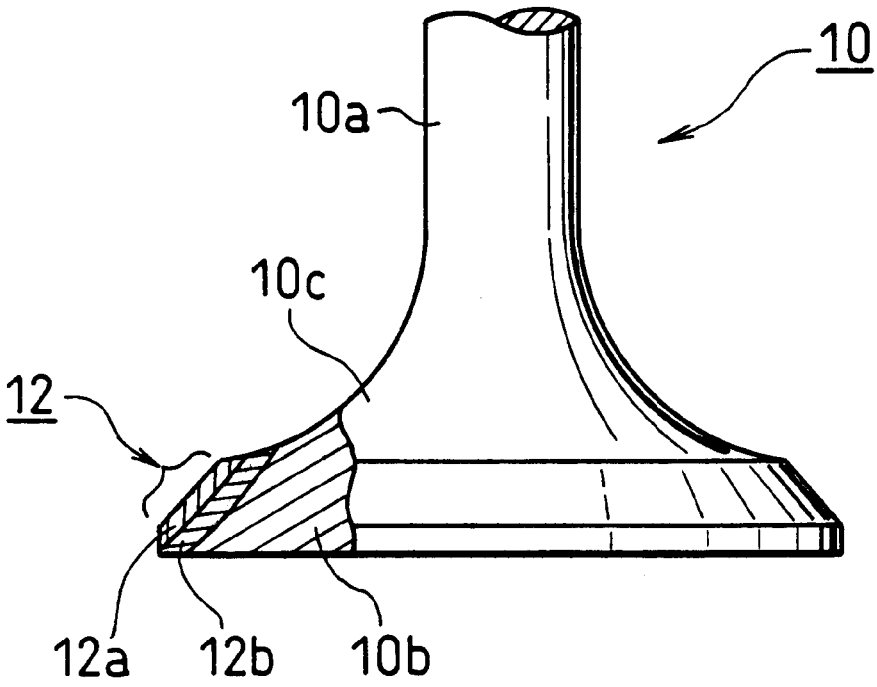
FIG. 1 is a partially sectional side view in which a valve face of a valve head of a poppet valve according to the present invention is partially cut away.

FIG. 1 illustrates a section of a valve face of a valve head of an inlet valve 10 in an internal combustion engine. The inlet valve 10 is made of Al alloy such as Al—Si and Al—Si—Cu. The valve head 10*b* is provided at the lower end of a valve stem 10*a*.

In the valve face 12 tapered from the lower end of a valve stem 10*a*to a rear valve head portion 10*c*, the surface layer 12*a* is formed as thermal hardened layer, and an inner layer 12*b* is made of a reinforcement material such as Ti, Cr, Ni, Cu, Mn, Fe and Co, or an alloy layer of two or more reinforcement elements thereof. The alloy layer has hardness of 250 to 300 Hv which is much higher than hardness of Al matrix of 120 to 150 Hv.

The alloy layer formed at the lower portion includes intermetallic compounds of Al matrix and reinforcement material, thereby increasing mechanical strength of the inner layer 12*b*.

Figure 2:
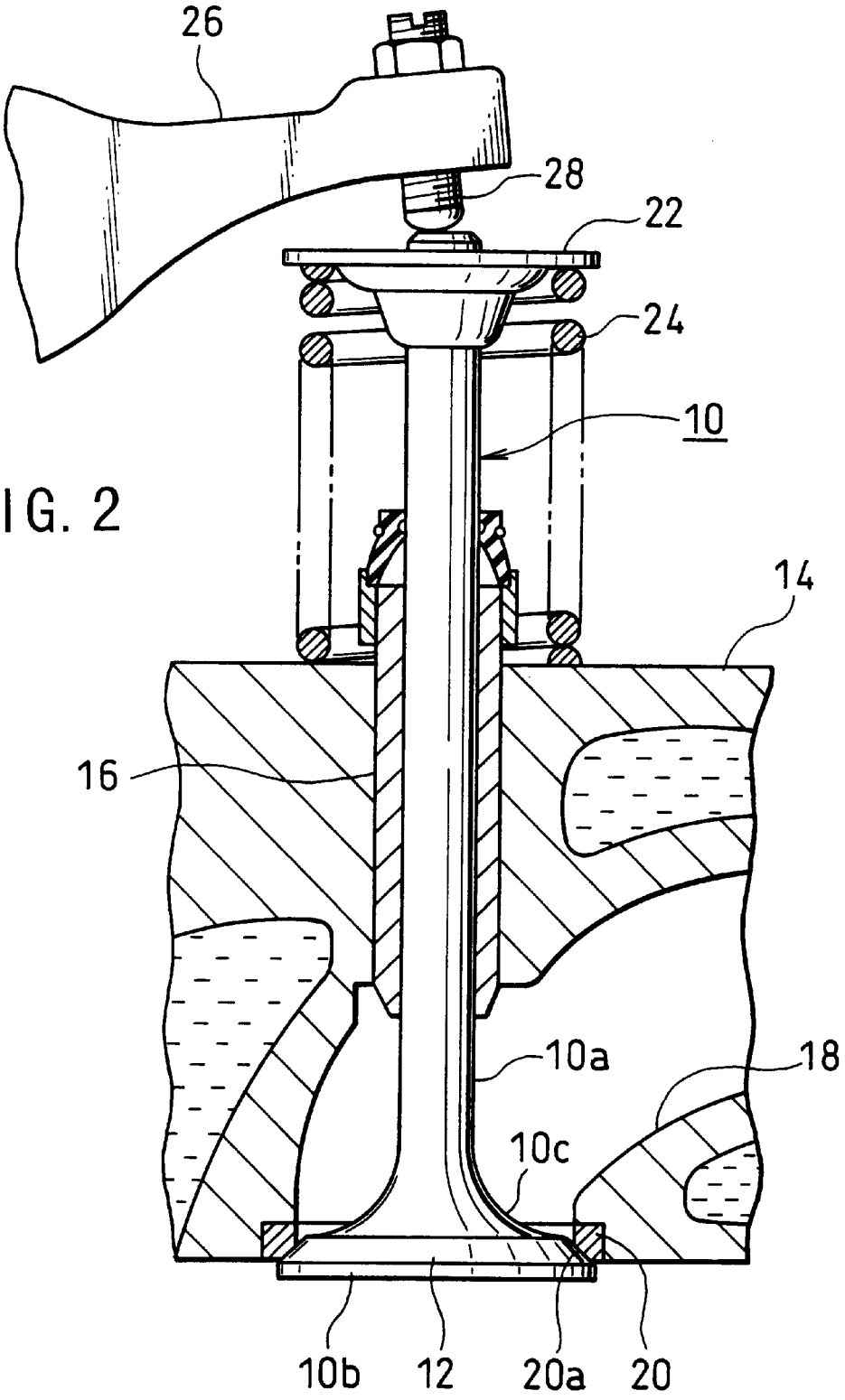
FIG. 2 is a vertical sectioned front view of a valve operating mechanism which contains the poppet valve according to the present invention.

Operation of the inlet valve will be described as below. FIG. 2 illustrates the inlet valve 10 mounted to a cylinder head 14. As shown in FIG. 2, the valve stem 10*a*of the inlet valve 10 is slidably inserted in a valve guide 16 of the cylinder head 14. The valve face 12 of the inlet valve 10 is engaged on a seat portion 20*a* of a valve seat 20 at the lower end of an inlet port 18 when an inlet port is closed by the inlet valve, Large impacting force is applied onto the valve face 12 by engagement with the valve seat 20. However, the surface layer 12*a* comprises a hardened layer, and the inner layer 12*b* comprises an alloy layer, thereby increasing durability to impact significantly.

At the upper end of the valve stem 10*a* of the inlet valve 10, a spring retainer 22 is mounted via a pair of cotters (not shown). Between the spring retainer 22 and the upper surface of the cylinder head 14, a valve spring 24 is provided to bias the inlet valve 10 upwards.

Above the inlet valve 10, a rocker arm 26 which moves up and down by a cam (not shown) is provided, and the upper end of the inlet valve 10 is pressed by the lower end of an adjuster bolt 28 which is engaged at the end of the rocker arm 26, thereby opening the valve.

A method of manufacturing a valve in an internal combustion engine will be described as below.

Figure 3:
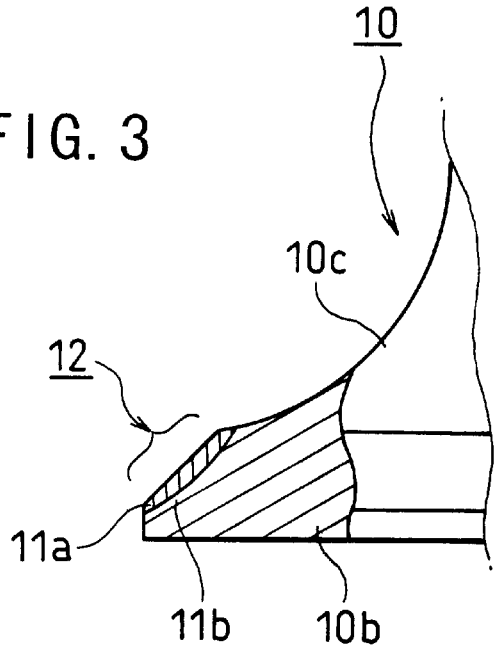
FIG. 3 is an enlarged sectional view of the valve face of the poppet valve, showing one step of a method according to the present invention.
Figure 4:
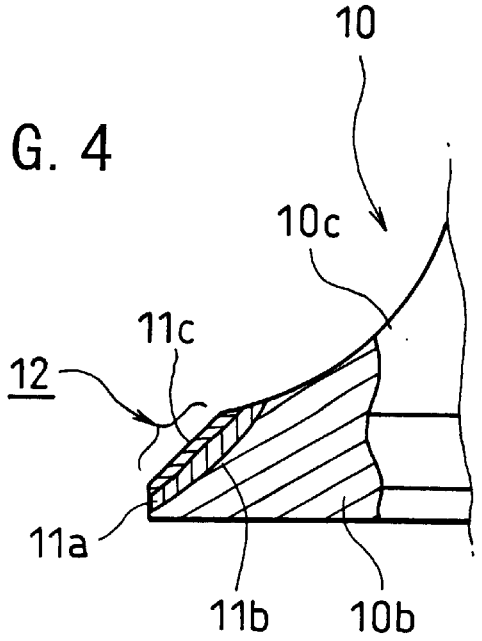
FIG. 4 is an enlarged sectional view of the valve face, showing another step of the method according to the present invention.

FIGS. 3 and 4 illustrate the valve face in each step for forming a thermal hardened layer and an alloy layer on the inlet valve 10 as shown in FIG. 1.

On the surface of the valve face 12, powdery materials of reinforcement elements such as Ti, Cr, Ni, Cu, Mn, Fe and Co are applied and heated by high energy heating means such as YAG laser, $CO_2$ laser and electronic beam. Thus, as shown in FIG. 3, an alloy layer 11*a* which contains an alloy and intermetallic compounds are formed on the valve face 10, thereby obtaining hardness of 250 to 300 Hv.

A YAG laser is preferable as high energy heating means, but $CO_2$ laser has low efficiency because of high reflection rate of the Al matrix. The surface of the valve face 10 is corroded by acidic or alkaline substance to form uneven surface, thereby accerating absorption of heat energy.

In the inner layer 11*b* in FIG. 3, there is formed heat-affecting annealed portion which has low hardness, thereby providing buckling during movement of the valve 10. Thus, T6 treatment under JIS (Japanese Industrial Standards) is applied to the valve face 10, thereby recovering hardness of the inner layer 11*b*. By T6 treatment, hardness of the alloy layer is decreased to about 200 Hv once. In the meantime, hardness of Al matrix is increased to 120 Hv to 150 Hv by T6 treatment. T6 treatment means heating which comprises the steps of rapid cooling by water quenching after heating at about 500° C., and then heating for several hours at 100 to 200° C.

Then, the valve face 10 is heated again by the high energy heating means such as YAG laser to melt the surface layer again and to form the thermal hardened layer on the outermost surface layer 11*c* of the valve face 10. Thus, hardness of the outermost surface layer 11*c* of the valve face 10 is increased to 250 to 300 Hv. Accordingly, mechanical strength of the valve face 10 is much increased together with the alloy layer 11*a*, thereby increasing durability and reliability of the inlet valve 10.

The foregoing merely relate to embodiments of the invention. Various modifications and changes may be made by persons skilled in the art without departing from the scope of claims wherein:

What is claimed is:

1. A poppet valve made of an Al or Al alloy matrix in an internal combustion engine, said valve comprising a valve stem and a valve head at an end of the valve stem said valve head having a valve face which is engageable on a valve seat, a reinforcement metal selected from the group consisting of Ti, Cr, Ni, Cu, Mn, Fe, and Co being supplied onto the valve face, and melted to make a reinforcement alloy layer, a surface of which is heated for several hours at about 500° C., rapidly cooled by water quenching, heated at 100 to 200° C. for several hours, and melted again with heating to make a thermal hardened layer on the reinforcement alloy layer of the valve face, said reinforcement alloy layer being higher in hardness than the matrix of the poppet valve, the thermal hardened layer being higher in hardness than the reinforcement alloy layer.

2. A poppet valve as claimed in claim 1 wherein the matrix is made of Al—Si or Al—Si—Cu.

3. A poppet valve as claimed in claim 1 wherein the melting is made by high density energy means.

4. A poppet valve as claimed in claim 3 wherein the high density energy means comprises YAG Laser, $CO_2$ laser or electronic beam.

5. A poppet valve as claimed in claim 3 wherein the high density energy means comprises YAG laser.

6. A poppet valve as claimed in claim 1 wherein the reinforcement metal comprises Cu.

* * * * *